United States Patent [19]

Verdu

[11] 4,119,176

[45] Oct. 10, 1978

[54] FALL ARRESTER, FOR BUILDING WORKS

[76] Inventor: Vicente Mira Verdu, Jose Antonio, 15, Jijona (Alicante), Spain

[21] Appl. No.: 836,892

[22] Filed: Sep. 26, 1977

[30] Foreign Application Priority Data

Sep. 29, 1976 [ES] Spain ..... 223512[U]

[51] Int. Cl.[2] ..... E04G 21/32

[52] U.S. Cl. ..... 182/138; 182/82

[58] Field of Search ..... 182/137, 138, 139, 140, 182/113, 82

[56] References Cited

U.S. PATENT DOCUMENTS

| | | | |
|---|---|---|---|
| 3,603,428 | 9/1971 | Hanses | 182/82 |
| 3,949,834 | 4/1976 | Nusbaum | 182/138 |

FOREIGN PATENT DOCUMENTS

| | | | |
|---|---|---|---|
| 36,542 | 3/1965 | German Democratic Rep. | 182/138 |

*Primary Examiner*—Reinaldo P. Machado

*Attorney, Agent, or Firm*—Eyre, Mann, Lucas & Just

[57] ABSTRACT

A Y-shaped support structure is movably attached at its two arms to a track vertically attached adjacent the face of a building. Two of the arms of the Y-shaped support structure are movably engaged in a slot in the track and a net is suspended between the support structure and a similar support structure on a parallel track. The support structures with attached net can be raised by removing the supports from the upper arms of the Ys and sliding the ends of the upper arm upward while folding the net toward the building, then supporting the upper arms while the lower arms are raised while simultaneously unfolding the support structure outward, and finally supporting the bottom arms of the Ys. The support structure is lowered by reversing the procedure for raising it.

8 Claims, 6 Drawing Figures

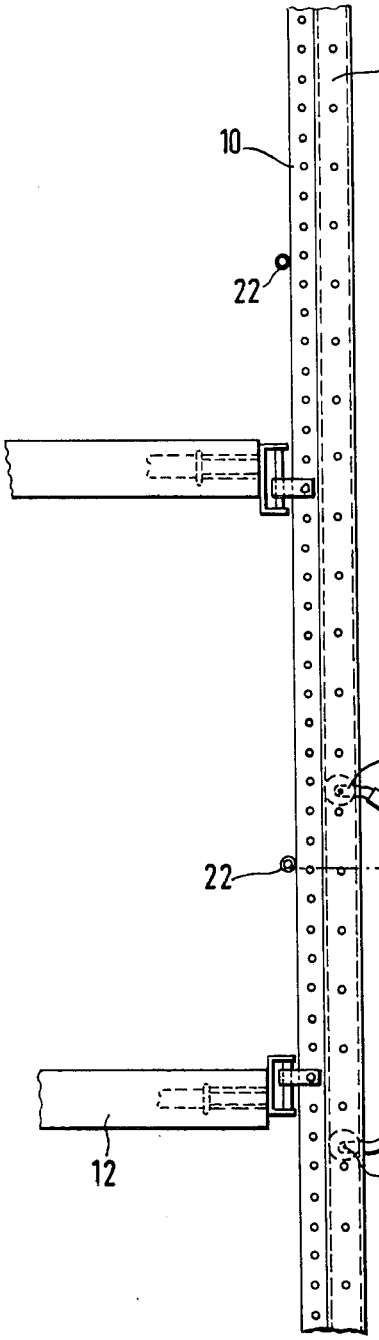
FIG. 2
FIG. 5
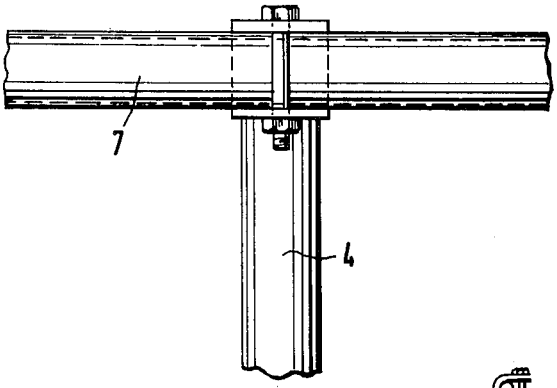
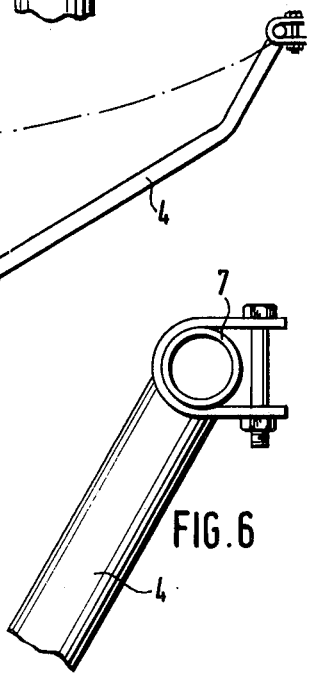
FIG. 6

FALL ARRESTER, FOR BUILDING WORKS

In the construction of buildings or similar works, safety standards are at present required to be complied with in order to prevent accidents, arising both from possible falls suffered by the workers, as well as from falling objects or materials, which may strike persons located in the vicinity of the works.

Among known arrangements for this purpose, one of the most widely adopted is that which entails placing a series of safety nets at locations where required, with each one of the lengths being extended between two side supports, which are directly attached to the frame structure of the building.

The above mentioned arrangement affords absolute safety in use, but nonetheless, all known constructions which follow this basic conventional idea, have the drawback whereby their erection is a complicated process, making it particularly difficult to place the device with its safety net at the right height so as effectively to accomplish its purpose as the building proceeds at ever differing heights, with the result that the procedure required for moving the net is a slow and complex one, this being aggravated by the fact that it is attached to the building with means which in themselves hinder the progress of work on same.

In order to overcome these disadvantages, the present invention provides for a safety net structure wherein each supporting arm frame is pivoted to allow it to be folded at will, and each is provided with a supporting and attachment point.

The aforementioned supporting and attachment points are each provided with a sliding device, these all being housed in a single travel guide, which is provided with means for holding using an original system, so that the attachment of the travel guides does not hinder progress on the building work, since they remain wholly independent therefrom. Said attachment, having female sockets, is attached to the building structure to hold the supporting arm frame. This system is very much more secure than any kind of arrangement using clasping members. The holding means serve both the purpose of accomplishing the attachment to the building structure at a selectable height, as well as for anchoring said travel guides.

Each supporting arm frame is arranged in conjunction with at least two travel guides these each being attached in relation and alignment to two consecutive storeys of the building, and initially the supporting arm frame is joined to the lowermost guide. Said supporting arm frames, of which there are always at least two, may be arranged in a continuous relationship to one another.

The arrangement is allowed to remain in this, its operational position, until such time as when, due to the growth of the building, it becomes necessary to transfer it to the next storey up, whereupon it is only necessary to unlock its uppermost support and to fold the frame, so that said uppermost free support will run or slide along the travel guides until it takes up its new attachment position on the travel guide above.

Once this has been accomplished, the support which has travelled is secured, and the other is freed, so that now it is only necessary to unfold the frame until it resumes the operational position, for said freed support to become similarly displaced and rise to its new attachment position on the travel guide above.

In this way, with a high degree of simplicity and in a minimum amount of time, the safety net can be moved from one storey to another, while it is also to be noted that once this change over has been accomplished, the lower travel guides can be released and left free in order to be moved up to the next storey above that where the net is now located, and thus be available there in readiness for later use.

As may be appreciated from all that has been described up to now, the fall arrester system covered herein, being of great simplicity in construction, allows a high degree of efficiency in its function, together with simple handling, these all comprising features which distinguish it notably with respect to everything else which up to now has been known, and which features in themselves afford the system a full independence of its own.

An outstanding feature is the convenience afforded by the original arrangement whereby the system is attached to the building structure, since it is quite independent from the actual building itself. If a whole travel guide is used on the building face and on its intermediate parts, the construction is fully protected by means of the railings which may thus be attached at each storey so as to arrest any falling body, because when fitted at the proper height, they comprise a steady guard.

FIG. 2 is a side elevational view of the fall arrester structure.

FIG. 5 is a front elevational view of the attachment members on the outer side of the net.

FIG. 6 is a side elevational view of FIG. 5.

The present invention is concerned with a fall arrester for building works, it being of the kind where there is a series of identical frames which support the net, and where said series is comprised of at least two units.

Figure 1:
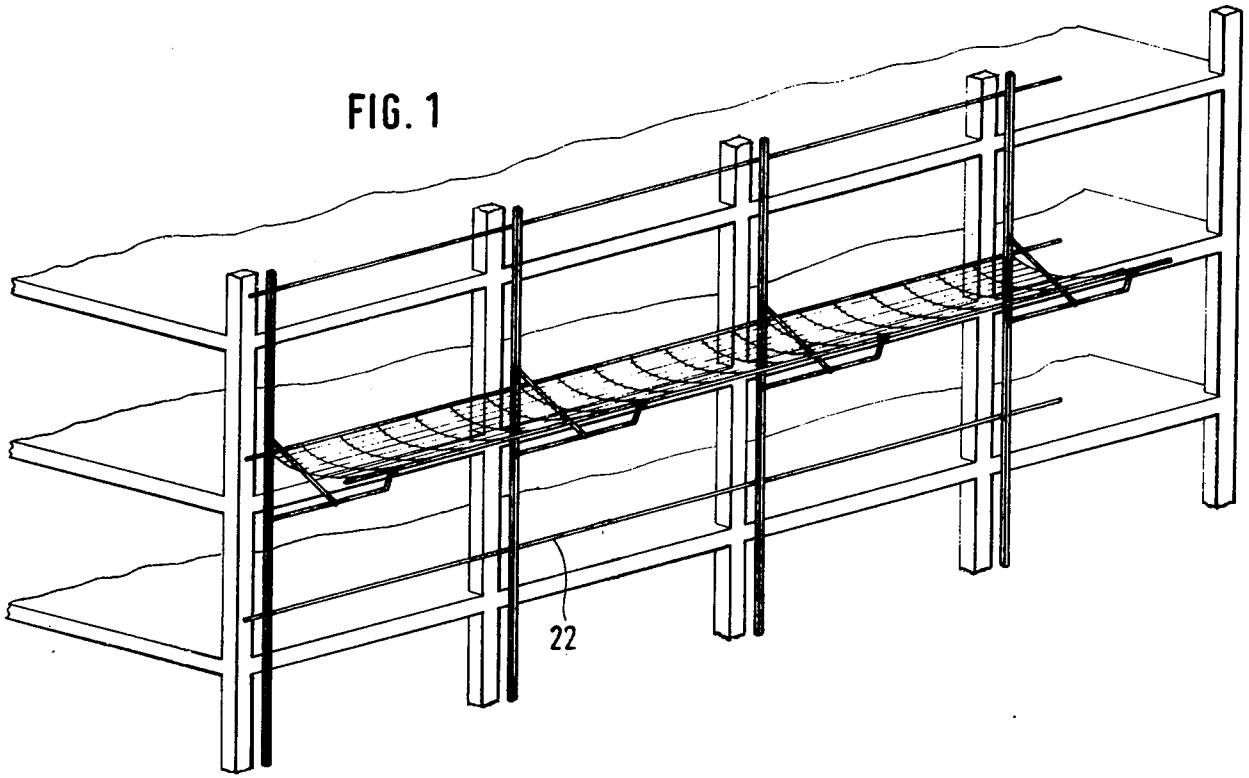
FIG. 1 is a perspective view of the fall arrester.

Each supporting arm frame is, as may be seen from FIGS. 1 and 2, comprised of a structure whose shape is generally like that of a "Y," being defined by two struts 3, 4, of which the former is the shorter in length and is pivotally attached at one of its ends to the latter, by means of a pivoted joint 5.

It is between the upper ends of struts 3, 4 that the net is extended, while at the same time it is the end of the former of these two struts which, together with the lower end of strut 4, comprises the holding and attachment points shown respectively as numbers 2 and 6 on the attached drawing.

Figure 3:
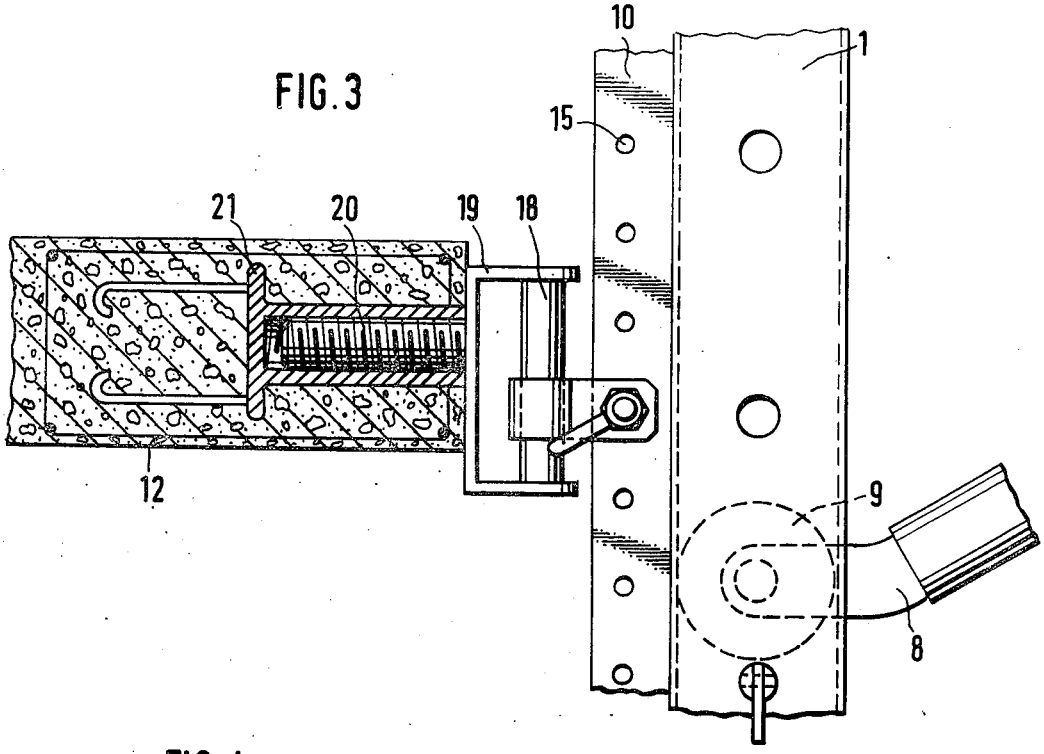
FIG. 3 is a side elevational view which shows the anchoring members to hold the supporting arm frames to the building structure.
Figure 4:
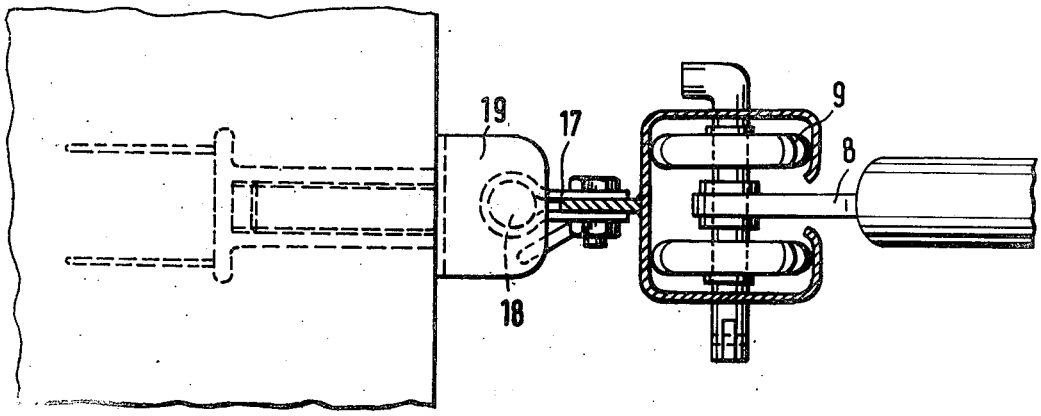
FIG. 4 is a plan view on FIG. 3.

Referring now to FIGS. 3, and 4, each one of the holding and attachment points 2 or 6 is provided, by virtue of a supporting strip 8, with means for running or sliding, these being comprised of ball or roller bearings 9 fitted into a single body to accommodate them.

Ball or roller bearings 9 belonging to both struts 3 and 4 are housed inside a single channel guide 1, and this, by means of a holed strip of flange 10, is solidly attached to the support, which likewise can be seen in FIG. 3.

Guide channel 1 is, moreover, provided with a line of drilled holes 15, which accommodate bolts for attaching it to lug member 17. There is provision for height adjustment of the sliding members belonging to support points 2 and 6 on each supporting arm frame. A pin 23 may be inserted through a selected one of a line of drilled holes 24 in the guide channel 1 thereby to support bearing 9.

Lug member 17 is attached through pivot 18 onto bracket 19, upon whose opposite side, there is a threaded stud 20, which may either be positioned in the centre, or towards the upper end of said bracket 19.

A female socket 21 is embedded in the building structure 12, and can take and hold the threaded stud 20.

When the building work is completed, or when the fall arrester moved elsewhere, the female socket 21 is left where it is in the building structure 12 for further use as may be required at some other time.

In the manner described, guide channel 1 can be attached to the building structures 12, and said guide channel may either be continuous or in lengths, but in either case it must extend over the height of at least two consecutive storeys.

If the guide channel 1 is fitted in lengths, then each one is arranged in alignment with the rest, and each supporting frame is initially attached to the lower guide channel 1.

When, because of the progress made in work upon the building, it becomes necessary to move the safety net up to the storey immediately above, the first thing to be done is to release the attachment at point 2, and to fold the frame.

Whilst folding of the frame takes place, point 2 will be made to travel along the length of the guide channel 1 as far as a position where it is made secure once more.

With the frame in this position, the attachment at point 6 is now released, and thereupon said frame is unfolded again, in such a way that said point 6 is likewise made to move upwards, until it reaches its new position for fastening as required.

In this way, it will be seen how by means of a quick and very simple series of manoeuvres, there is at all times throughout the operation, always one point in the fastened position, so as to prevent the frames from falling.

In the case where the guide channel is made up from several lengths, the procedure afterwards is to release the guide channels 1 which are left free, and to attach them then to the storey above that where the net is now positioned, in readiness for use later on.

As it may readily understood, the procedure for moving the structure in a downwards direction is similar to that which has already been described, the only difference being the order in which supporting points 2 and 6 are released.

As may be seen from FIG. 5, the end of struts 4 is fitted with cross member 7 which may be made of a single part or several, in which latter case the plurality of parts in question is shaped at one of its ends into the form of an eye, to enable it to be attached to the next piece by means of a pin.

These cross members 7 are provided for the purpose of supporting the outer edge of the net.

Support for the inner edge of the net is provided by means of its being attached to cross members 7, similar to those described above, or to a rope instead of said cross members.

A further construction comprises the use of rails 22 attached to flange 10 at a height which is approximately the same as that where supports and attachments 2 are placed, with the net being joined to said rails.

I claim:

1. An improved fall arrester for building works, comprising: a safety net, at least two supporting arm structures for said net, each of said supporting arm structures having first and second struts, the first end of said first strut being pivotally joined to the intermediate portion of said second strut thus forming the shape of a letter "Y," at least one vertical guide channel attached to said building for each of said supporting arm structures, support means for holding the second end of said first strut and a first end of said second strut in said at least one vertical guide channel, said safety net being slung, between the second ends of said second struts, said support means for holding containing means for permitting the longitudinal motion of the ends of the struts attached thereto in said guide channel and means for securing said support means at a predetermined height in said guide channel whereby the supporting arm structures, and safety net, may all be travelled along the length of the vertical guide channels, and, be secured at said height.

2. An improved fall arrester for building works, in accordance with claim 1, further comprising each guide channel being in several lengths, each length being provided with means for attachment to the building to which the arrester is applied, means for permitting the fall arrester supporting arm frames to be positioned at the required height along said several lengths, whereby at least one guide channel is not occupied by a means for holding, the at least one length of guide channel which remains free may be released from its position, and placed in a new position in line with the guide channels in use, so as to be there in readiness for use when later required.

3. An improved fall arrester for building works, in accordance with claim 1, further comprising: means for releasing one of the upper or lower support means on said supporting arm frame from said guide channels, whereupon the strut thus released is free to travel along the guide channels as far as required to assume the new position in which it is to be secured, and means for releasing the other of the support means whereby the fall arrester supporting arm frame is unfolded, so that said other pair of support means is likewise allowed to travel along the guide channels until they assume the new position in which they are to be secured.

4. An improved fall arrester for building works, in accordance with claim 1, further comprising: a plurality of female sockets anchored into the building structure, supporting means for holding the guide channels and means for connecting the supporting means to the female sockets.

5. An improved fall arrester for building works, in accordance with claim 1, further comprising: a railing attached between at least two guide channels for preventing the fall of any kind of body.

6. A fall arrester for use during work on a building comprising:

(a) At least two vertical guide channels;

(b) means for connecting said guide channels adjacent to a face of said building;

(c) a support structure in each of said guide channels and projecting outward from said face;

(d) said support structure being first and second struts pivoted together at one end of said first strut and an intermediate portion of said second strut to form a Y;

(e) means for attaching the second end of said first strut and a first end of said second strut to said guide channel;

(f) said means for attaching being effective to permit longitudinal motion of said support structure along said guide channel;

(g) means for supporting said means for attaching at selected positions; and (h) a net attached between second ends of second struts of at least two support structures.

7. A fall arrester in accordance with claim 6 further comprising:

(a) side guide channel having a hollow rectangular cross section with a slot in one side thereof, at least one perimeter of said slot forming a guide track inside said guide channel;

(b) at least first and second rollers inside said guide track rollably engaged with said guide track;

(c) the second end of said first strut and the first end of said second strut passing through said slot and respectively engaging said at least first and second rollers; and (d) means for supporting said first and second rollers at selected heights within said guide track.

8. A method of erecting and moving a fall arrester comprising:

(a) attaching at least two guide channels adjacent to the face of a building;

(b) engaging rollers attached to two hinged-together Y-shaped support arms inside each guide channel;

(c) attaching a net between the outer ends of two support arms;

(d) supporting one of said rollers;

(e) moving the other roller within said guide channel with respect to said one roller;

(f) supporting said other roller;

(g) moving said one roller within said guide channel with respect to said other roller (h) repeating steps (d) through (g) to move said support arms to the selected height; and (i) supporting both of said at least two rollers in both of said at least two guide channels.

* * * * *